US005587861A

United States Patent [19]

Wieloch et al.

[11] Patent Number: 5,587,861

[45] Date of Patent: Dec. 24, 1996

[54] METHOD FOR INTERRUPTING ELECTRICAL POWER BETWEEN TWO CONDUCTORS

[75] Inventors: Christopher J. Wieloch; Mark A. Kappel, both of Brookfield; Jeffrey R. Annis, Waukesha, all of Wis.; David J. Benard, Newbury Park, Calif.; Ellen Boehmer, Thousand Oaks, Calif.; Gernot Hildebrandt, Simi Valley, Calif.

[73] Assignee: Allen-Bradley Company, Inc., Milwaukee, Wis.

[21] Appl. No.: 536,712

[22] Filed: Sep. 29, 1995

[51] Int. Cl.[6] ..... H01H 73/00

[52] U.S. Cl. ..... 361/14; 361/115; 335/174; 335/201

[58] Field of Search ..... 361/14, 58, 93, 361/99, 115; 335/15, 18, 16, 20, 21, 41, 155, 174, 180, 182, 195, 201, 203, 204, 78–86, 124, 128, 131

[56] References Cited

U.S. PATENT DOCUMENTS 5,164,693 11/1992 Yokoyama et al. ..... 335/29

5,466,903 11/1995 Faber et al. ..... 335/176

*Primary Examiner*—Todd DeBoer

*Attorney, Agent, or Firm*—Patrick S. Yoder; John M. Miller; John J. Horn

[57] ABSTRACT

A method for interrupting electrical power between two conductors is provided, including biasing an electrically conductive element into a conducting position between two contact regions of the conductors. The contact regions are preferably portions of arc runners coupled to the conductors. The conductors surround a magnetic core that generates an electromagnetic field due to current in the conductors. The conductive element is repelled to a non-conducting position by the electromagnetic field in response to an overcurrent condition in the conductors. A secondary response mechanism is moved in response to the overcurrent condition to maintain the conductive element in the non-conducting position. For more gradually occurring overcurrent conditions, the secondary response mechanism is attracted toward the core, displacing the conductive element to the non-conducting position. Arcs generated by movement of the conductive element are rapidly expanded under the influence of a magnetic field, thereby rapidly increasing the voltage opposing the fault current.

26 Claims, 4 Drawing Sheets

28
36
24
36
40
42
16
26
40
42
26
54
22
50
46
44
24
46
54
52
12
31
29
28
24
14
36
60
60
16
50
14
52
16
34
34
56
58
58
38
34
34
32
38

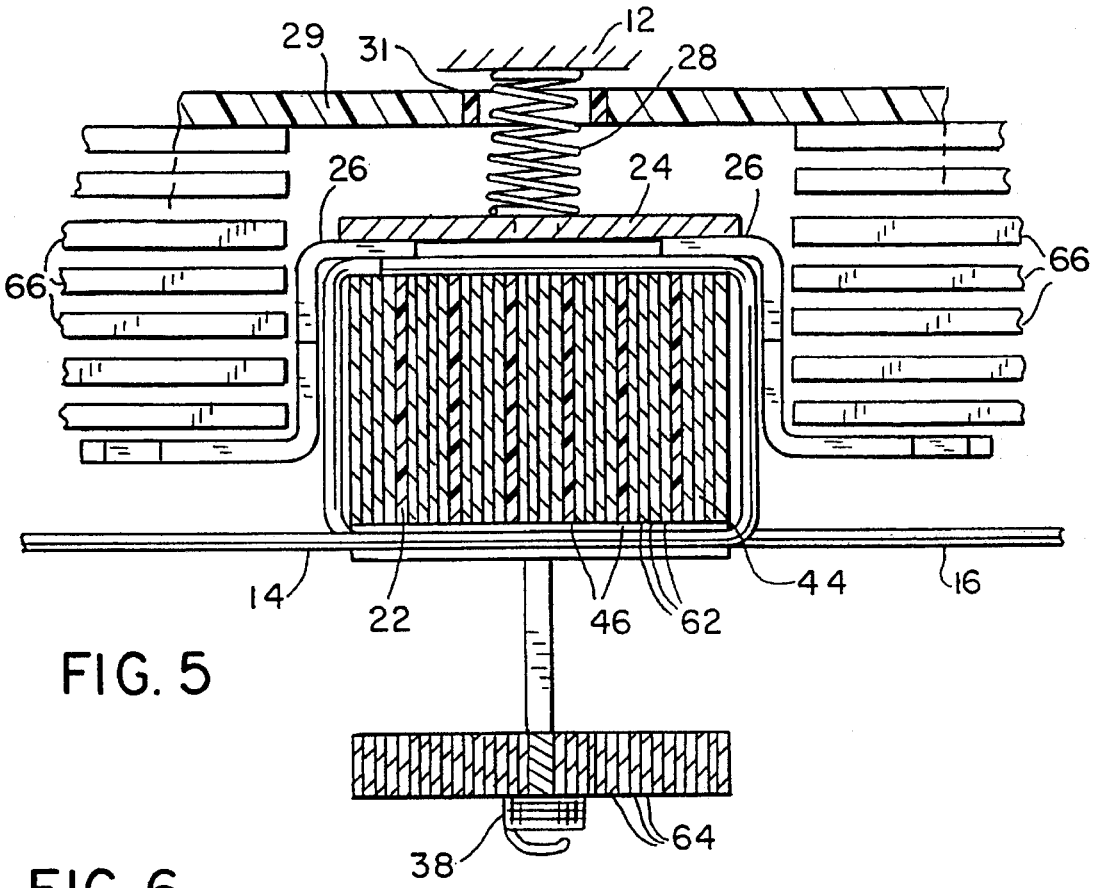
FIG. 5
FIG. 6
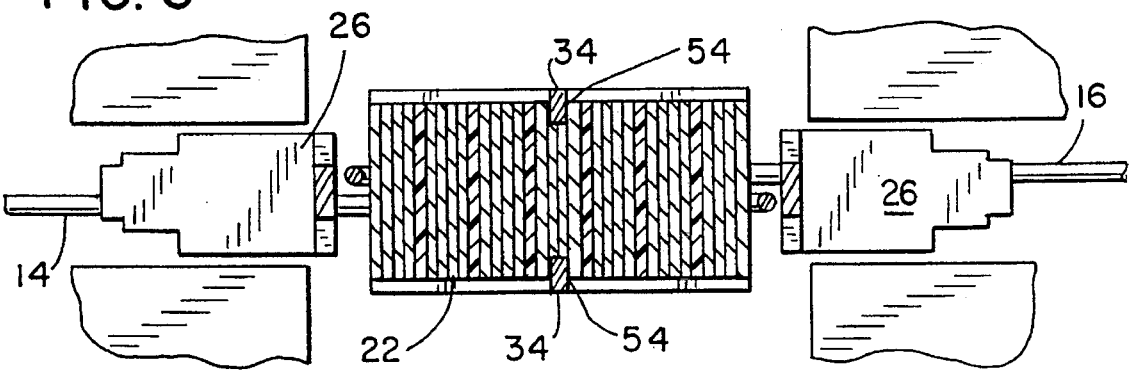
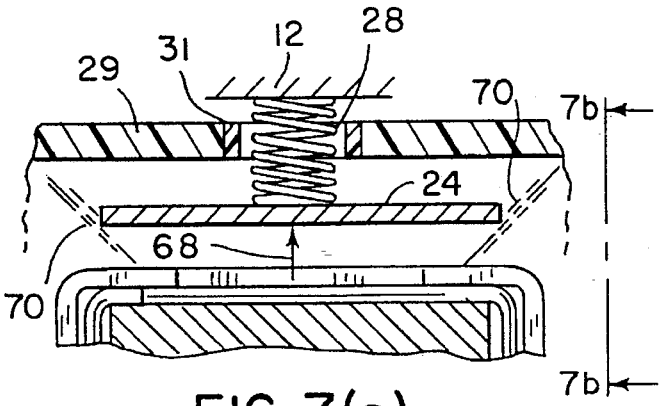
FIG. 7(a)
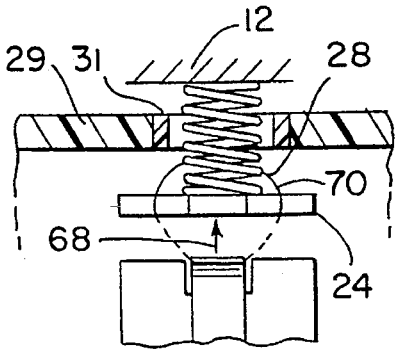
FIG. 7(b)

METHOD FOR INTERRUPTING ELECTRICAL POWER BETWEEN TWO CONDUCTORS

CROSS-REFERENCE TO RELATED APPLICATIONS

The present application is related to a U.S. Patent Application entitled "Apparatus for Interrupting Electrical Power between Two Conductors" in the name of Wieloch et al., filed on even date herewith and assigned to the assignee of the present application.

BACKGROUND OF THE INVENTION

The present invention relates generally to the art of electrical circuit interrupting devices. More particularly, the invention relates to a method for rapidly disconnecting a current path between two electrical conductors in response to an overcurrent condition or other circuit malfunction, such as a short circuit.

A large number of devices and methods are known for interrupting electrical power between conductors in response to overcurrent conditions, such as short circuits, phase loss, ground faults and the like. Such devices are typically designed into both residential and industrial electrical system for protecting electrical wiring, as well as devices such as contactors, motor starters, appliances and electric motors. In general, such protective devices include fuses and circuit breakers. Fuses are typically sacrificed by the overcurrent condition and must be thereafter replaced. Circuit breakers, on the other hand, typically physically open contacts in response to a tripping event and may thereafter be reset, either automatically following a cooling period, or by physical intervention of a user.

While existing circuit interrupting approaches of this type offer a range of response times and protection characteristics, they are not without drawbacks. For example, in certain environments and applications where extremely rapid power interruption is required, semiconductor fuses generally offer satisfactory response time, on the order of 0.6 milliseconds. However, such fuses are relatively expensive and must be physically replaced following a tripping event. While circuit breakers of known design may be reset, thereby avoiding the additional cost of replacement after a tripping event, they are typically substantially slower than fuses, having turnoff times (i.e. time to open and interrupt power) of typically 4 milliseconds. Moreover, the let-through energy in such devices increases as a function of the cube of their turnoff time, so long as the current rise is controlled by the source voltage and the circuit inductance, which is typically the case for a hard fault. Thus, circuit breakers responding in twice the time as fuses let through some eight times the energy, increasing the risk of damage to wiring or electrical devices intended to be protected.

In the case of circuit breakers, rapid turnoff of current is typically limited to the rate at which arcs generated during opening of the circuit interrupter at the heart of the device can be extinguished. While such devices can rely on a natural zero crossing in alternating current sources, such techniques are generally much too slow to adequately protect sensitive loads. Instead, to minimize the turnoff time, circuit breakers must develop a voltage opposing the arcs in a very short time. Several sources of opposing voltage in circuit breakers include steady state ohmic resistance of the arcs, space charge voltages at the points of arc attachment, induction voltages due to motion of the arcs (or conductors) through a magnetic field, and transient arc voltages resulting from the initial formation and growth of the arcs. Commuting arcs into a series of splitter plates is an established method of increasing the number of space charges opposing a fault current in conventional circuit breakers. However, such techniques do not provide a sufficiently rapid turnoff time to protect sensitive loads. Moreover, while circuit breakers have been designed to use induction effects, these have typically been physically large and expensive. Finally, steady state ohmic resistance of arcs is typically too small to permit reduction of fault current necessary for circuit breaking action.

There is a need, therefore, for an improved method for interrupting electrical power between two conductors that offers extremely short turnoff times, while not requiring replacement of expendable elements such as fuses. Moreover, there is a need for an improved method that is susceptible to implementation in relatively simple devices such as circuit breakers. Such devices should be capable of responding both to very rapidly occurring overcurrent conditions, such as short circuits, and to more gradually changing conditions associated with other types of overloads.

SUMMARY OF THE INVENTION

The present invention features a novel method for breaking a current path between two conductors that is designed to respond to these needs. The method calls upon electromagnetic field forces to repel a conductive element from a contact position to a non-contact position. Moreover, arcs generated by movement of the element are rapidly expanded under the influence an electromagnetic field, thereby increasing the opposing voltage and promoting rapid extinction of the arcs.

Thus, in accordance with a first aspect of the invention, a method for interrupting electrical power between first and second conductors includes a first step of biasing an electrically conductive spanner into a conducting position wherein electrical power is conducted between the first and second conductors. The spanner is then repelled in response to an excessive current condition to move the spanner to an interrupted position wherein electrical power between the first and second conductors is interrupted. Expansion of arcs produced during movement of the spanner is directed to generate a voltage tending to extinguish the arcs.

In accordance with another aspect of the invention, a method for interrupting an electrical conducting path between two conductors includes the steps of biasing an electrically conductive element into contact with portions of the conductors, electromagnetically lifting the conductive element from the conductor portions, and electromagnetically directing expansion of arcs between the conductive element and the conductor portions.

In accordance with a further aspect of the invention, a method for interrupting electrical power between two conductors comprises a first step of biasing an electrically conductive element into contact with contact regions electrically coupled to the conductors. The conductive element is electromagnetically repelled into a non-contact position to interrupt power between the conductors in response to overcurrent conditions of a first magnitude. A slow response mechanism is electromagnetically moved to interrupt power between the conductors in response to overcurrent conditions of a second magnitude.

BRIEF DESCRIPTION OF THE DRAWINGS

The present invention will become more fully understood from the following detailed description, taken in conjunction with the accompanying drawings, wherein like reference numerals refer to like parts, in which:

FIG. 5 is a sectional view of the circuit interrupter of FIG. 2 along section line 5—5;

FIG. 6 is a sectional view of the circuit interrupter of FIG. 2 along section fine 6—6;

FIGS. 7A and 7B are side and end views, respectively, of the circuit interrupter of FIG. 2, illustrating the orientation of expanding arcs generated by movement of the spanner from its conducting position to its non-conducting position in response to an overcurrent condition in the conductors.

DESCRIPTION OF THE PREFERRED EMBODIMENTS

Figure 1:
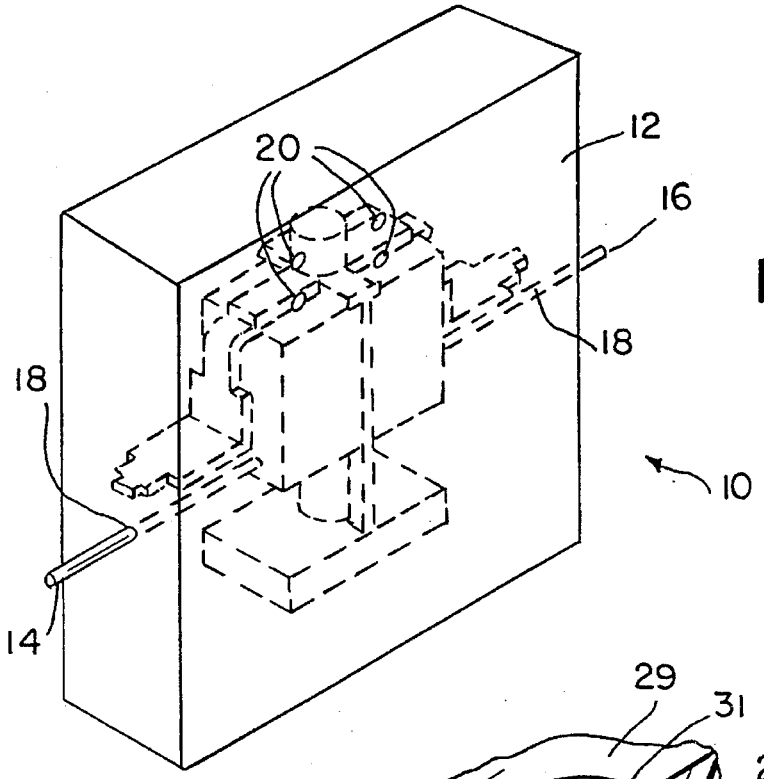
FIG. 1 is a perspective view of an exemplary circuit interrupter shown encased in an enclosure.

Turning now to the drawings and referring first to FIG. 1, a circuit interrupter 10 is illustrated as encased in an enclosure 12 from which first and second conductors 14 and 16 protrude. Conductors 14 and 16 extend through apertures 18 provided in ends of enclosure 12 and, in a typical application, will be coupled to screw terminals, clips or similar connections of the type found in circuit breakers of known design. Apertures 18 are preferably sealed around conductors 14 and 16, such as by an epoxy or similar sealant. Vent apertures 20 are provided in enclosure 12 for permitting the escape of gases compressed during interruption of electrical power between conductors 14 and 16 as described below.

Figure 2:
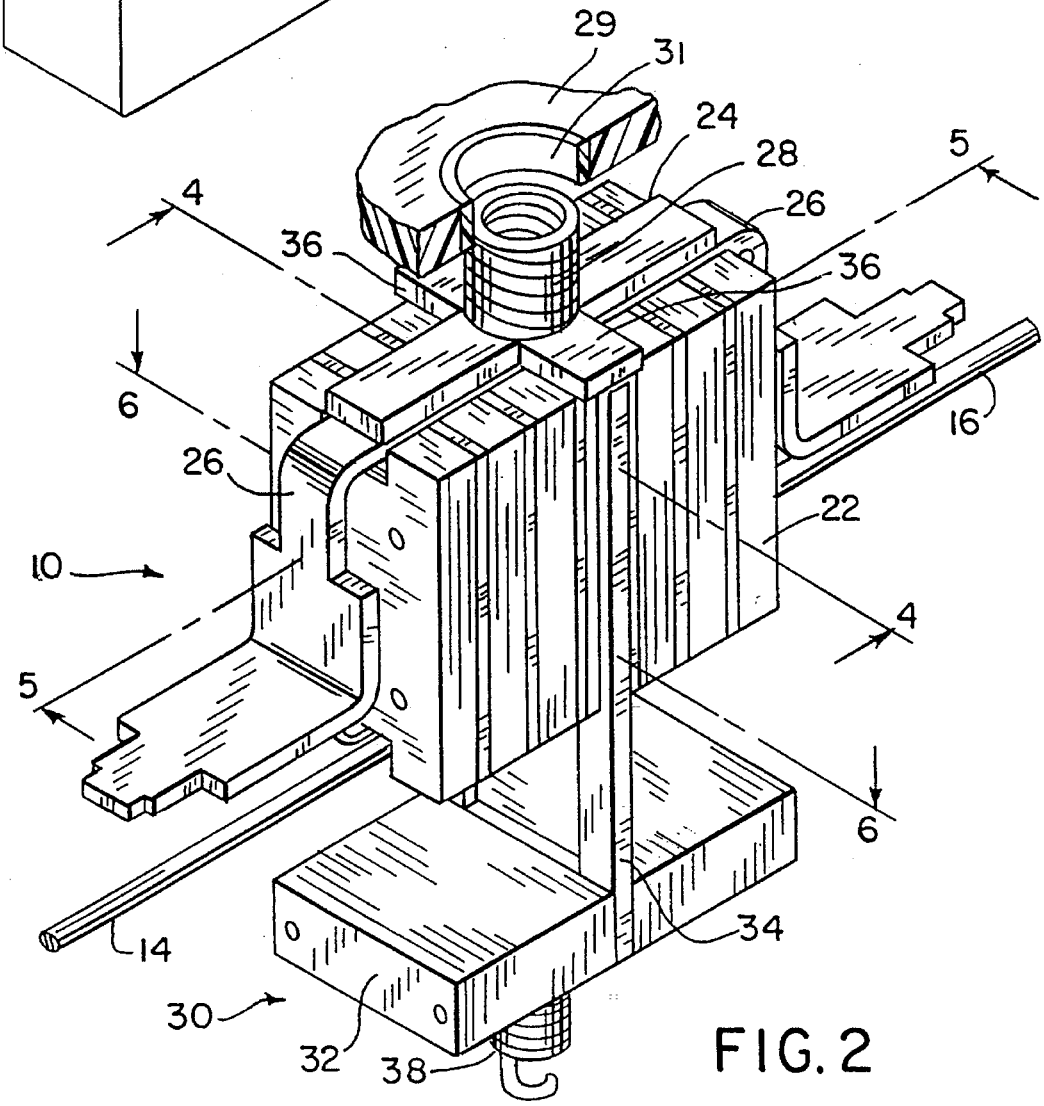
FIG. 2 is a perspective view of the circuit interrupter of FIG. 1, without the enclosure, illustrating a preferred arrangement of the core, arc runners and spanner.

As shown in FIG. 2, circuit interrupter 10 includes a core 22, an electrically conductive element or spanner 24 and arc runners 26. Core 22, which is preferably made of layers of magnetic material separated by intermediate layers of insulating material, forms an electromagnet around which conductors 14 and 16 are wrapped. Arc runners 26 are made of an electrically conductive material, such as a copper alloy. Each arc runner 26 is electrically coupled to one of the conductors 14, 16 and is disposed adjacent to core 22. Spanner 24 is biased into contact with arc runners 26 via a compression spring 28 that penetrates through a shunt plate 29 and bears against a portion of enclosure 12 (see FIGS. 4 and 5). An insulating ring 31 is provided in shunt plate 29 to avoid contact between spring 28 and shunt plate 29. Thus, in its biased position, spanner 24 establishes a current path between conductors 14 and 16 via arc runners 26 through contact with arc runners 26. Spanner 24 is movable upwardly against the force of spring 28 in response to overcurrent conditions in conductors 14 and 16 as described below.

A secondary response mechanism 30 is provided on a side of core 22 opposite to the position of spanner 24. In the presently preferred embodiment illustrated, secondary response mechanism 30 includes a body 32 comprising a magnetic material, such as a ferromagnetic alloy, alignment and actuating arms 34 extending from body 32, and a biasing extension spring 38. Spring 38 extends between body 32 and a lower portion of enclosure 12 (not shown) to urge body 32 away from core 22 into the position illustrated in FIG. 2. In this biased position, body 32 preferably rests spaced from core 22 until drawn toward core 22 as described below. Body 32 is movable toward core 22, against the force of extension spring 38 in response to overcurrent conditions in conductors 14 and 16. Alignment and actuating arms 34 maintain secondary response mechanism 30 in alignment with respect to core 22 and contact lateral extensions 36 of spanner 24 when moved toward core 22 in response to an overcurrent condition.

Figures 3, 4:
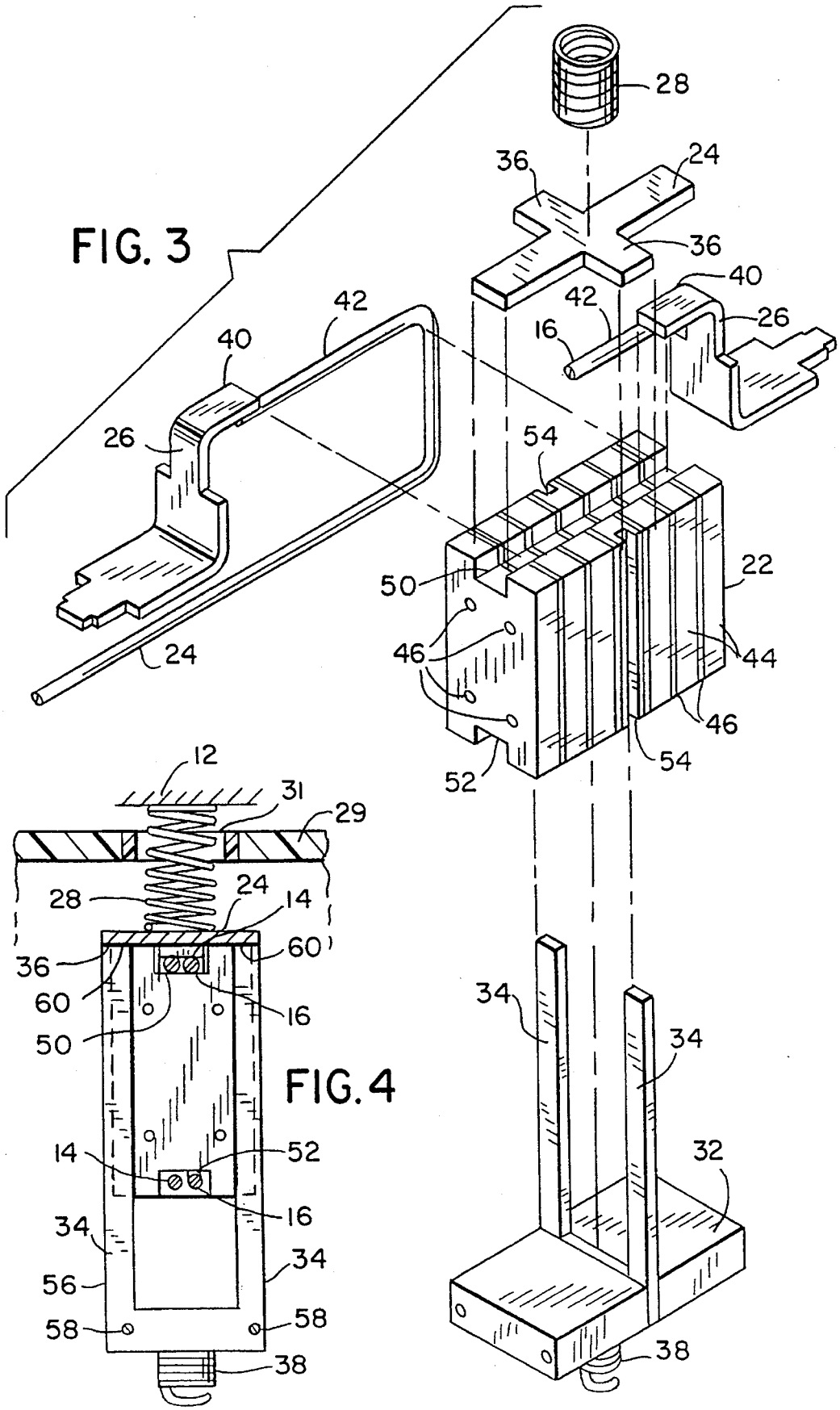
FIG. 3 is an exploded view of portions of the circuit interrupter of FIG. 2 illustrating a presently preferred arrangement of the core and conductors.
FIG. 4 is a sectional view of the circuit interrupter of FIG. 2 along section line 4—4.

FIG. 3 illustrates a presently preferred arrangement of the elements described above. Conductors 14 and 16 are bent or wrapped at least partially around core 22 (only conductor 14 is fully illustrated in FIG. 3 for the sake of clarity). Each conductor 14, 16 is electrically coupled to an arc runner 26 in a contact region 40 on an upper portion 42 of the conductor. Conductors 14, 16 are preferably insulated, such as by a thin Kapton covering to electrically isolate them from one another and from core 22. From contact regions 40, conductors 14, 16 extend parallel to one another around core 22 to exit enclosure through apertures 18 as shown in FIG. 1.

Core 22 is preferably formed in a manner similar to conventional parallel plate high voltage armature cores. As best shown in FIG. 3, core 22 includes several magnetic sections 44 separated by insulating layers 46. Magnetic sections 44 are preferably formed by stacking stamped metal plates having a generally H-shaped profile. Insulating layers 46, which have a profile similar to magnetic sections 44, are preferably stamped from Kapton sheet material, or a similar insulator. Magnetic sections 44 and insulating layers 46 are assembled (e.g. stacked) to form core 22, with unifying tie rods 48 traversing sections 44 and 46 to maintain core 22 in a tight, unified structure. Tie rods 48 are preferably made of an electrically insulating material. Insulating layers 46 and tie rods 48 eliminate or reduce arcing between sections 44 of core 22.

The profiles of sections 44 and insulating layers 46 define upper and lower channels 50 and 52 respectively. As best illustrated in FIG. 4, conductors 14 and 16 are disposed at least partially within channels 50 and 52 as they extend around core 22. While in the structure illustrated in the figures, conductors 14 and 16 wrap once around core 22, such conductors may complete more than one turn around the core. In a presently preferred embodiment, conductors 14 and 16 complete from 1 to 4 turns around core 22. In addition to lodging conductors 14 and 16, channels 50 and 52, in cooperation with arc runners 26, conductors 14 and 16, and spanner 24, contribute to shaping a high gradient electromagnetic field around core 22 permitting very rapid actuation of interrupter 10 as described below. In particular, a shaped magnetic field in the region surrounding contact regions 40 promotes the extremely rapid expansion and extinction of arcs generated by movement of spanner 24. In the presently preferred embodiment, channels 50 and 52 have a generally rectangular cross-sectional shape and extend over the entire length of core 22. However, alternative configurations may be provided, including channels of different cross-sectional shape, channels extending over only a portion of the length of core 22, and upper and lower channels having different shapes or lengths.

A section 44 near the midpoint of core 22 preferably defines vertical grooves 54 extending along the entire height of core 22. When assembled in interrupter 10 as shown in FIG. 2, arms 34 of secondary response mechanism 30 are partially lodged in grooves 54. Grooves 54 thus serve to guide mechanism 30 in vertical displacement in response to overcurrent conditions in conductors 14 and 16. As shown in FIG. 4, a center portion of mechanism 30 is preferably configured as a generally U-shaped member 56, a bottom portion of which forms part of body 32 and sides of which form arms 34. Tie rods 58 hold U-shaped member 56 assembled in body 32 and maintain body 32 in a solid, unified structure. Spring 38 is positioned below body 32 and is secured to body 32 and to a lower portion of enclosure 12 (not shown) by suitable clips, detents or the like, to bias body 32 away from core 22. In this biased position, upper ends 60 of arms 34 are positioned just below or adjacent to lateral extensions 36 of spanner 24. Thus, as body 32 is electromagnetically drawn towards core 22 in response to an overcurrent condition in conductors 14 and 16, upper ends 60 of arms 34 urge or maintain spanner 24 in a raised or non-conducting position as described in detail below.

The preferred construction and arrangement of core 22, secondary response mechanism 30 and the other elements of circuit interrupter 10 are illustrated in greater detail in FIGS. 5 and 6, wherein core 22 and body 32 are shown in cross-section. As shown in FIG. 5, core 22 comprises a plurality of plates 62 made of magnetic material and stacked in sections 44. Sections 44 are separated by layers 46 of insulating material. Body 32 is similarly constructed of layers 64 of magnetic material stacked on either side of U-shaped member 56. As shown in FIG. 6, arms 34 fit within grooves 54 of core 22 and are slidable within the grooves. Conductors 14 and 16, coupled to arc runners 26, extend around core 22, passing through channels 50 and 52 and between core 22 and body 32. While core 22 has a generally rectangular profile, comers of core 22 may be rounded to prevent damage to conductors 14, 16 or to their insulation. In a particularly preferred embodiment illustrated in FIG. 5, splitter plates 66, are provided adjacent to arc runners 26 on either side of core 22. The construction and placement of such splitter plates 66 are well known in the art of circuit breakers.

Circuit interrupter 10 operates as follows. During normal operation (i.e. prior to the occurrence of an overcurrent condition in conductors 14 and 16), spanner 24 is maintained in its biased or conducting position in contact with regions 40 of arc runners 26. In this position, spanner 24 preferably rests partially or completely within upper channel 50. Body 32 is biased away from core 22 such that upper ends 60 of arms 34 permit spanner 24 to contact arc runners 26. In its biased position, spanner 24 thus completes a current conducting path between conductors 14 and 16. Spanner 24 is preferably made of copper or a similarly highly conductive material and is as low mass as feasible, while still providing sufficient cross-sectional area to conduct a rated current for the device.

Circuit interrupter 10 responds to overcurrent conditions in conductors 14 and 16 differently depending upon the relative magnitude of the current flowing through conductors 14 and 16. For gradually occurring conditions wherein the current level through conductors 14 and 16 rises at a relatively slow rate, such as in response to a motor or circuit overload, body 32 of secondary response mechanism 30 is drawn toward core 22 by an electromagnetic field below core 22 resulting from current in the conductors and the effects of core 22, thereby contacting extensions 36 and urging spanner 24 out of contact with arc runners 26. For more suddenly occurring overcurrent conditions, such as due to direct short circuits and the like, spanner 24 is repelled away from core 22 by an electromagnetic field above the core, again resulting from current flowing through conductors 14 and 16. During the repelled displacement of spanner 24 in response to such overcurrent conditions, secondary response mechanism 30 is also displaced, although more slowly than spanner 24. Before spanner 24 can return to its biased position and thereby recontacting regions 40, a catch mechanism (not shown), such as a spring biased pawl or similar device may contact spanner 24 and retain it in a non-conductive position out of contact with arc runners 26. In addition, upper ends 60 of arms 34 may contact extensions 36 to maintain spanner 24 in a raised or non-conducting position.

A particularly advantageous feature of the structure described above is its ability to direct extremely rapid expansion, and thereby extinction of arcs generated between spanner 24 and arc runners 26 as spanner 24 is displaced from its conducting position to its non-conducting position in response to both gradual and sudden overcurrent conditions. In particular, while conventional circuit interrupting devices, such as circuit breakers, typically extinguish arcs produced by opening of the current conducting path by leading the arcs to splitter plates and thereby increase the number of space charges opposing the fault current, the present device also promotes fast volumetric expansion of the arcs to force a high energy investment in the arcs, thereby more rapidly increasing the voltage opposing the fault current. When this reverse voltage becomes sufficient to reduce the incoming fault current substantially to zero, the arcs are de-ionized, and cooled.

FIGS. 7A and 7B illustrate the direction of expansion of arcs generated by movement of spanner 24. As indicated by arrow 68, as spanner 24 is displaced away from core 22, compressing spring 28 through shunt plate 29 and against enclosure 12, either by urging by arms 34 in response to a gradual overcurrent condition or by repulsion in response to a sudden overcurrent condition, arcs 70 expand very rapidly from arc runners 26 to either end of spanner 24. The extremely rapid expansion of arcs 70 is enhanced by the electromagnetic field surrounding are runners 26 due to current flowing through conductors 14 and 16 and around core 22. Moreover, the particular shapes of core 22 and channel 50 create a high gradient electromagnetic field that aids in shaping the arcs, thereby causing very rapid propagation of the arcs in space and a high rate of volumetric expansion. Because such volumetric expansion causes a rapid increase in the internal energy of the arcs, the voltage required to support them also increases rapidly, forcing a more rapid reduction of the input current to zero than has heretofore been available in conventional circuit breakers. Once the input fault current is thus reduced to zero, power input to the arcs is interrupted, permitting de-ionization and radiant cooling of the arcs. By way of example only, the inventors have found that a device of the type described above, having an approximately 300 mg copper spanner, obtained a turnoff time of approximately 0.6 ms. In direct fault conditions, velocities of as high as 30 m/s were attained by spanners in such devices within 100–200 microseconds of the beginning of the fault condition.

Figure 8A:
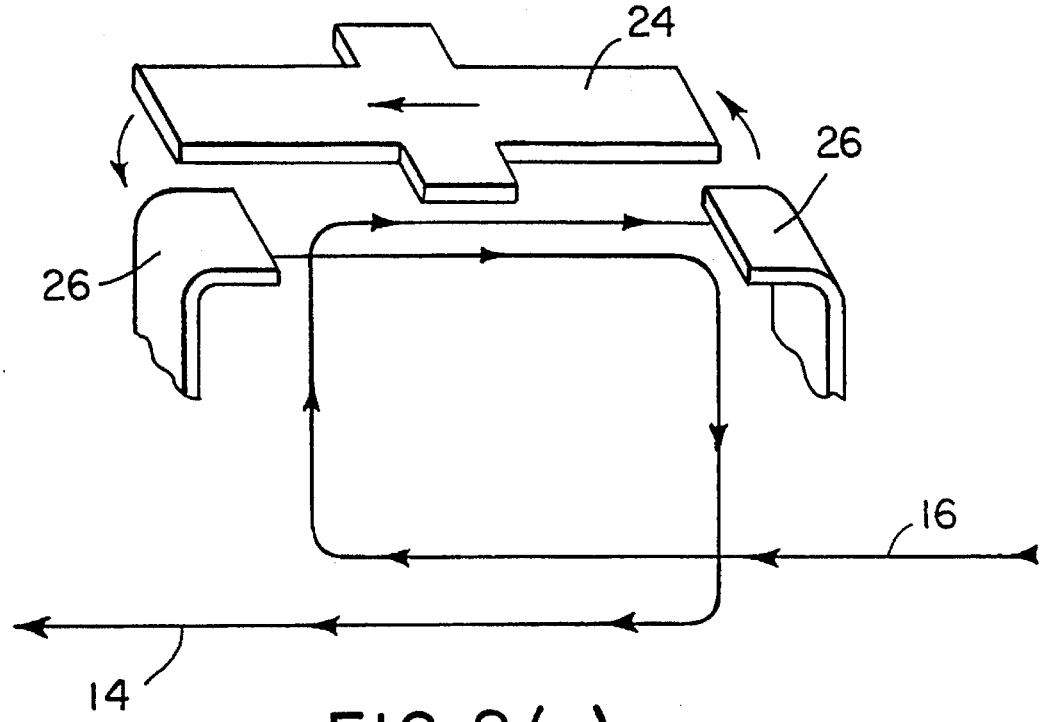
FIGS. 8A and 8B are diagrammatical illustrations of the current flow and electromagnetic field orientations that contribute to displacement of the spanner for interrupting power between the conductors.
Figure 8B:
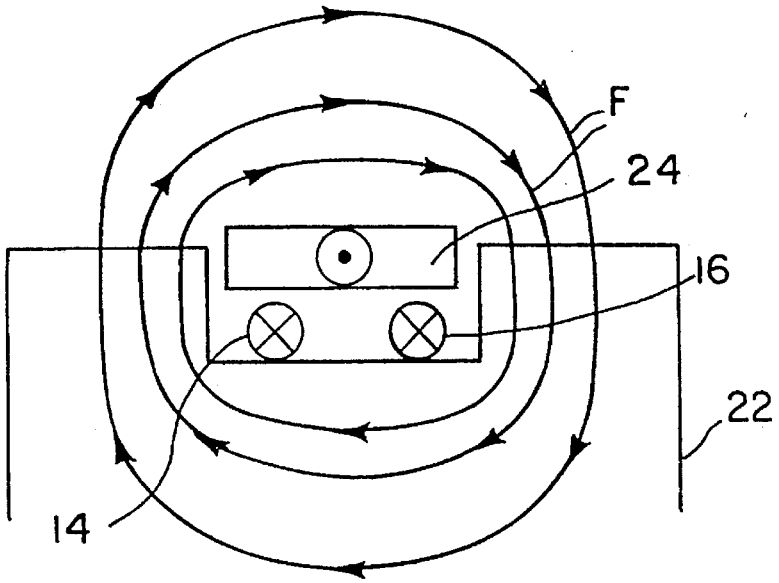

FIGS. 8A and 8B illustrate the instantaneous current relationship between conductors 14 and 16, and spanner 24 that contributes to the repelled displacement of spanner 24 in response to overcurrent conditions. In FIG. 8A, spanner 24 is shown lifted from arc runners 26 for illustrative purposes only. At any given point in time, current flows through conductors 14 and 16, through arc runners 26 and through spanner 24. The direction of current through spanner 24 is opposite to the direction of current through the portions of conductors 14 and 16 underlying spanner 24. As shown in FIG. 8B, current in conductors 14 and 16 creates a magnetic field F surrounding spanner 24 and tending to lift spanner 24 from core 22 due to a Lorentz repulsive force owing to the orientation of current in spanner 24.

It should be noted that another particularly advantageous feature of the structure and technique described above is the application of a generally uniform motive force to spanner 24 to cause its displacement. In particular, in known circuit interrupting devices the rate of movement of a circuit opening member has typically been limited by the physical ability of the member to withstand bending stresses caused by a non-uniform motive force tending to displace it in response to an overcurrent event. In the present device, on the other hand, the electromagnetic field created by conductors 14 and 16, and core 22, results in a more uniformly applied load, permitting further reduction in the mass of spanner 24 than has been heretofore feasible in existing structures. Moreover, vent apertures 20 in the present design permit the escape of gases compressed or moved by movement of spanner 24, thereby permitting displacement of spanner 24 toward its non-conducting position without undue air resistance. As such gas is being vented, gases heated by arcs 70 serve to force spanner 24 even more rapidly to its non-conducting position and further contribute to rapid expansion of the arcs.

It should also be noted that, while heretofore known circuit interrupter devices have relied upon a variety of physical phenomenon to generate a reverse voltage opposing fault current, the foregoing structure and technique advantageously generate an extremely rapidly increasing reverse voltage through the rapid volumetric expansion of arcs created during the displacement of spanner 24. Thus, while splitter plates 66 are helpful in further dissipating energy in the device, an initial large build-up in reverse voltage may be attributed to the directed expansion of the arcs.

While the embodiments illustrated in the figures and described above are presently preferred, it should be understood that these embodiments are offered by way of example only. The invention is not intended to be limited to any particular embodiment, but is intended to extend to various modifications that nevertheless fall within the scope of the appended claims. For example, the preferred arrangement of vent apertures 20, as illustrated in FIG. 1, is in a generally square or rectangular pattern on either side of spanner 24, alternative locations for such vent apertures may be envisioned. Thus, vent openings may be provided in ends of enclosure 12, such as above apertures 18 and behind splitter plates 66. Moreover, it has been found that totally enclosing interrupter 10 (i.e. providing no vent openings in enclosure 12) also provides satisfactory performance.

We claim:

1. A method for interrupting electrical power between first and second conductors comprising the steps of:

(a) biasing an electrically conductive spanner into a conducting position wherein electrical power is conducted between the first and second conductors;

(b) repelling the spanner in response to an excessive current condition to move the spanner to an interrupted position wherein electrical power between the first and second conductors is interrupted; and (c) directing expansion of arcs produced in step (b) between the spanner and the first conductor and between the spanner and the second conductor to generate a voltage tending to extinguish the arcs.

2. The method of claim 1, wherein current is directed through the spanner in a first direction and current is directed through a portion of the conductors underlying the spanner in a second direction opposite to the first direction, and force for repelling the spanner in step (b) is provided by a Lorentz force due to current in the spanner and an electromagnetic field generated by current through the conductors.

3. The method of claim 1, wherein the spanner is accelerated at least in part by gases heated during expansion of the arcs.

4. The method of claim 1, including the further step of dissipating the arcs in splitter plates.

5. The method of claim 1, wherein at step (c), expansion of the arcs is generally confined to unidirectional expansion.

6. The method of claim 1, wherein at step (c), expansion of the arcs is directed by electrically conductive material at least partially surrounding regions of the conductors contacting the spanner in the biased position.

7. The method of claim 1, including the further step of venting gases heated by the arcs.

8. A method for interrupting an electrical conducting path between two conductors comprising the steps of:

(a) biasing an electrically conductive element into contact with portions of the conductors;

(b) electromagnetically displacing the conductive element from the conductor portions;

(c) electromagnetically directing and shaping expansion of arcs between the conductive element and the conductor portions to facilitate extinguishing the arcs.

9. The method of claim 8, wherein the portions of the conductors contacted by the conductive element include arc runners electrically coupled to the conductors.

10. The method of claim 8, wherein the conductive element is lifted from the conductor portions in step (b) by an electromagnetic field generated by electric current in the conductors.

11. The method of claim 10, wherein the electromagnetic field is generated by the conductors and a core around which the conductors are disposed.

12. The method of claim 8, wherein expansion of the arcs in step (c) is directed and shaped by an electromagnetic field generated by electric current in the conductors.

13. The method of claim 12, wherein the electromagnetic field is generated by the conductors and a core around which the conductors are disposed.

14. The method of claim 8, further comprising the step of dissipating the arcs through splitter plates.

15. The method of claim 8, further comprising the step of retaining the conductive element out of contact with the conductor portions following step (b) and before the conductive element can return into contact with the conductor portions.

16. A method for interrupting electrical power between two conductors comprising the steps of:

(a) biasing an electrically conductive element in contact with contact regions electrically coupled to the conductors to establish a current path therebetween;

(b) electromagnetically repelling at least a portion of the conductive element to move the conductive element out of contact with at least one contact region, and (c) electromagnetically directing expansion of arcs between the conductive element and the at least one contact region by an electromagnetic field generated by electric current in the conductors and a core around which the conductors are disposed.

17. The method of claim 16, wherein the at least one contact region includes an arc runner electrically coupled to one of the conductors.

18. The method of claim 16, wherein the conductive element is repelled in step (b) by an electromagnetic field generated by electric current in the conductors.

19. The method of claim 18, wherein the electromagnetic field is generated by the conductors and a core around which the conductors are disposed.

20. A method for interrupting electrical power between two conductors, upon detection of overcurrent conditions occurring at predetermined rates, comprising the steps of:

(a) biasing an electrically conductive element into contact with contact regions electrically coupled to the conductors;

(b) electromagnetically repelling the conductive element into a non-contact position to interrupt power between the conductors in response to overcurrent conditions occurring at a first predetermined rate, and electromagnetically moving a secondary response mechanism to interrupt power between the conductors in response to overcurrent conditions occurring at a second predetermined rate.

21. The method of claim 20, wherein the secondary response device is magnetically attracted to a core in step (b) and interrupts power between the conductors by urging the conductive element toward the non-contact position.

22. The method of claim 20, wherein the conductive element is repelled by a core around which the conductors are disposed.

23. The method of claim 20, wherein the secondary response mechanism is electromagnetically attracted by the core.

24. The method of claim 20, wherein the secondary response mechanism is electromagnetically moved to retain the conductive element in the non-contact position in response to overcurrent conditions occurring at the first predetermined rate.

25. The method of claim 20, further comprising the step of electromagnetically directing expansion of arcs between the conductive element and the contact region generated during movement of the conductive element to the non-contact position.

26. The method of claim 16, further comprising the step of electromagnetically moving a retaining device into contact with the conductive element to retain the conductive element in a non-contact position following step (b).

* * * * *